United States Patent [19]

Mason, Jr. et al.

[11] 4,091,371

[45] May 23, 1978

[54] TOUCH-RESPONSIVE PORTABLE INTRUSION ALARM

[75] Inventors: Stanley I. Mason, Jr.; John E. Pfeifer, both of Weston, Conn.

[73] Assignee: Simco, Inc., Weston, Conn.

[21] Appl. No.: 709,316

[22] Filed: Jul. 28, 1976

[51] Int. Cl.[2] ..... G08B 13/26

[52] U.S. Cl. ..... 340/274 R; 340/249; 340/258 B; 340/283

[58] Field of Search ..... 340/283, 258 B, 258 C, 340/274 R, 249

[56] References Cited

U.S. PATENT DOCUMENTS

| | | | |
|---|---|---|---|
| 3,349,386 | 10/1967 | Zug | 340/249 |
| 3,623,063 | 11/1971 | Fontaine | 340/283 |
| 3,924,253 | 12/1975 | Marino | 340/258 B |
| 4,011,554 | 3/1977 | Butler | 340/283 |

*Primary Examiner*—Glen R. Swann, III
*Attorney, Agent, or Firm*—Haynes N. Johnson

[57] ABSTRACT

An intrusion alarm is encased within a housing hung from a doorknob by a conductive strap which makes electrical contact with the doorknob apparatus. A monitoring circuit within the housing is connected to the hanging strap for sensing capacitance changes corresponding to touching of the exterior portion of the doorknob apparatus by a would-be intruder. Alarm means within the housing are activated by the monitoring circuit to generate a local audible alarm or an FM transmission signal sent to a remote receiver or both. A latching circuit maintains the alarm means in an activated state after the capacitance coupled to the doorknob apparatus has been removed, and switch means on the exterior of the housing are provided for resetting the alarm to a non-activated state to permit sensing of a subsequent capacitance change. The alarm further includes means for temporarily disabling the alarm device for a predetermined period of time during which it may be touched without activating an alarm signal. A status indicator is included to provide a flashing signal when the device is actuated and the batteries are supplying power.

5 Claims, 5 Drawing Figures

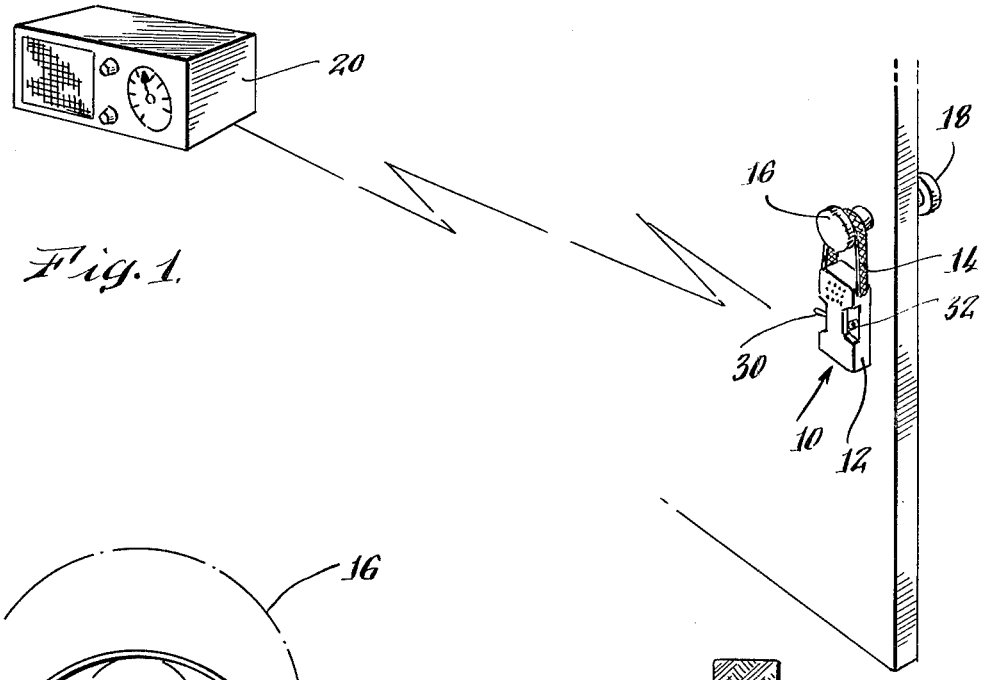
Fig. 1.
Fig. 2.
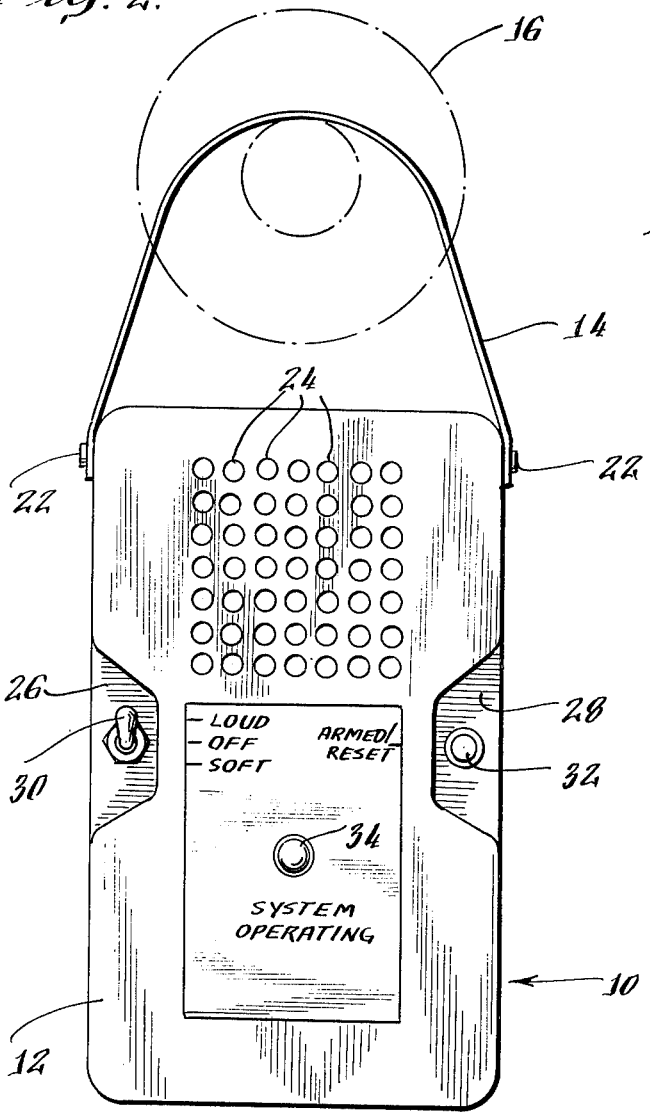
Fig. 3.
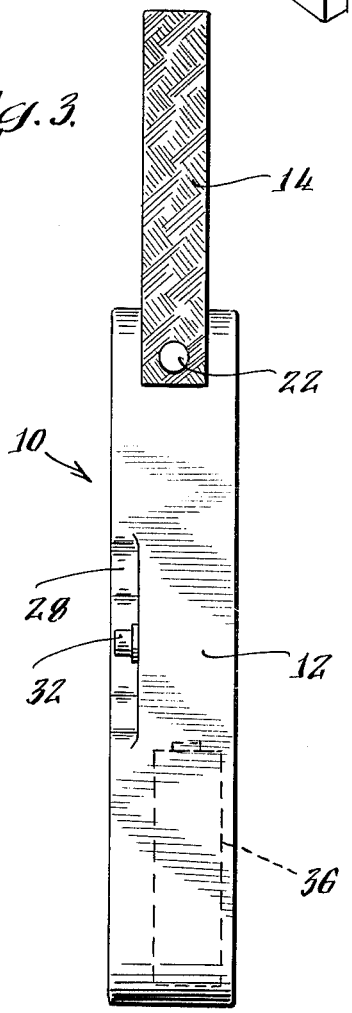

FM TRANSMITTER
58
30
36
HI
OFF
LOW
R23
56
Q13
R22
R19
54
Q12
R21
C12
C13
R20
Q11
MODULATOR
R18
+3V
VBB
OSCILLATOR 'B'
C3B
R1B
Q1B
C1B
R2B
C2B
VB
C2
R2
C4
R4
R1
VA
C1
40
Q1A
C3A
R1A
R2A
C1A
C2A
L1A
OSCILLATOR 'A'
14
STRAP ATTACHED TO DOORKNOB
D1
D2
R3
+1.2V
C3
T1
RP
RN
R15
R14
46
C8
48
Q7
D6
R13
Q6
C7
Q5
R12
Q18
R31
D9
62
Q17
C16
R30
32
RESET/ARM CKT
+3
44
R10
Q4
R9
D5
D4
R11
C6
R7
Q3
R8
R5
R6
D3
C5
PHASE DETECTOR
CLAMP
42
60
STATUS MONITOR
R28
34
Q16
C15
VS
R27
R26
Q15
C14
Q14
R24
R25
Z1
AUDIO OSCILLATOR
52
Q10
C11
Q8
R17
b2
b1
Q9
R16
50
DETECTOR
D7
C10
D8
C9

TOUCH-RESPONSIVE PORTABLE INTRUSION ALARM

BACKGROUND OF THE INVENTION

1. Field of the Invention

This invention relates to the field of intrusion alarms of the type electrically sensitive to the presence of a would-be intruder and arranged to sound an alarm whenever an electrical condition exists which corresponds to the presence of the intruder.

2. Description of the Prior Art

A variety of different intrusion alarms are known. Some prior art alarms are designed to be used in association with a doorknob apparatus to detect the presence of a would-be intruder, as exemplified by U.S. Pat. No. 3,508,239 to Fontaine, U.S. Pat. No. 3,774,191 to Enemark, and U.S. Pat. No. 3,824,576 to Pioch. A variety of sensing techniques also are known, as shown by the following U.S. patents:

| | |
|---|---|
| Mallory | 1,870,181 |
| Browning | 2,421,771 |
| Ripepi | 3,022,499 |
| Premack | 3,222,664 |
| Rode | 3,128,416 |
| Lister | 3,510,677 |
| Ralston | 3,778,807 |

Despite the abundance of known intrusion alarm devices, existing intrusion alarms are unsatisfactory in many ways. For example, existing intrusion alarms require time consuming installation, and thus are not suitable for use by travellers to guard the security of hotel doors and the like. Existing intrusion alarms, moreover, are passive except when an intruder appears, and are never to be fully relied upon since a failure would go unnoticed. In addition, existing intrusion alarms are somewhat awkward to use since, when set in an active state, they require the user to bypass the monitored apparatus completely to avoid sounding the alarm.

SUMMARY OF THE INVENTION

The principal object of the present invention is to provide an improved intrusion alarm device. Additional objects are to provide an intrusion alarm which is adapted for portable, self-contained use, which is able to sound a local or remote alarm, which provides a reliable indication that the alarm is in its active status and capable of detecting an intruder, and which can be temporarily deactivated so that the apparatus with which the alarm is associated, such as a doorknob, may be used before the alarm device becomes active.

In a preferred embodiment of the invention to be described hereinbelow in detail, the intrusion alarm is formed as a portable, self-contained device arranged to be hung from the interior portion of a doorknob apparatus and to sound an alarm whenever the exterior portion of the doorknob apparatus is touched by a would-be intruder. The alarm device comprises a housing, and conductive means such as a woven or braided metal strap for hanging the housing from a doorknob and for making electrical contact with the doorknob apparatus. A monitoring circuit within the housing and connected to the hanging means senses capacitance changes corresponding to touching of the exterior portion of the doorknob apparatus by a would-be intruder. Alarm means within the housing are activated upon the sensing of a capacitance change, and latching means within the housing maintain the alarm means in operation after a capacitance coupled to the exterior portion of the doorknob apparatus has been removed. Switch means on the exterior of the housing reset the alarm means to a non-activated state ready for sensing of a subsequent capacitance change.

In another aspect of the invention, the alarm device circuitry, which connects a source of electrical power to the monitoring circuit and alarm means through a switch to place the device either in an active or an inactive status, comprises a status indicator for periodically visually indicating the intrusion alarm device is in its active status. The status indicator includes means such as a threshhold oscillator circuit connected through said switch means to the source of electrical power for developing a periodic signal, and light emitting means such as a diode driven by the periodic signal to visually indicate that the switch means has placed the device in an active status and that the power source is supplying power to the device.

In still another aspect of the invention, the intrusion alarm device circuitry comprises means for temporarily disabling the alarm device for a predetermined period of time during which the monitored apparatus may be touched without sounding an alarm, and for thereafter automatically placing the alarm device in an active status responsive to touching of the monitored apparatus. Accordingly, the alarm device will permit a final use of the monitored apparatus before the alarm device becomes active. A door thus can be used for exiting after the alarm is turned on.

Other objects, aspects and advantages of the invention will be pointed out in, or apparent from, the detailed description hereinbelow considered together with the following drawings.

DESCRIPTION OF THE DRAWINGS

FIG. 1 is a perspective view illustrating the use of an intrusion alarm device constructed in accordance with the present invention;

FIG. 2 is a front elevation of the intrusion alarm device;

FIG. 3 is a side elevation of the intrusion alarm device; and

DESCRIPTION OF THE PREFERRED EMBODIMENT

Figure 4:
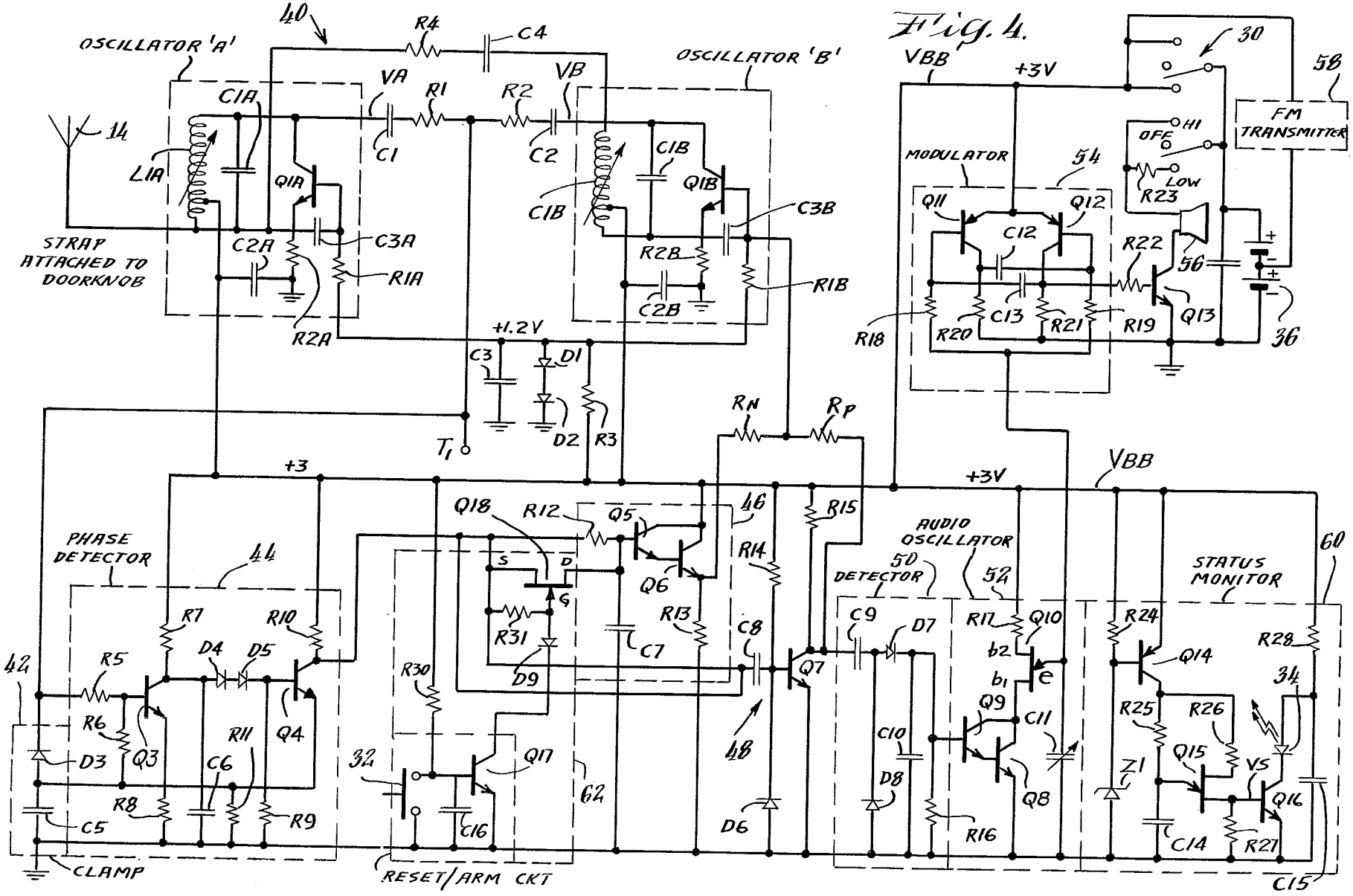
FIG. 4 is a schematic diagram of circuitry used by the intrusion alarm device.

FIG. 1 illustrates a portable, self-contained intrusion alarm 10 constructed in accordance with the present invention. As shown, the alarm comprises a housing 12 made, for example, from molded plastic. Connected to the housing is a conductive hanging strap 14 made, for example, from woven or braided metal wires or strands or a conductive plastic or elastomer, and used both for hanging from an interior doorknob 16 and for making electrical contact with the doorknob apparatus. As will be explained in detail below, whenever the exterior doorknob 18 is touched by a would-be intruder, the alarm device 10 sounds an alarm. The alarm may be selected to be a local audible alarm, and the alarm may also be transmitted as an FM signal to a remote FM receiver 20. One or both forms of alarm may be used. By providing for transmission of the alarm to remote receiver 20, it is possible to indicate, in a second story bedroom or in an adjacent apartment, for example, than an attempt at intrusion has been made upon an access door.

As shown in FIGS. 2 and 3, the hanging strap 14 is attached by means of pins 22 to the housing 12. The housing is generally rectangular in shape, having an apertured portion 24 for transmission of acoustic energy and two indentations 26 and 28 for mounting of switches 30 and 32. Switch 30 is a toggle switch arranged to place the device in either an active or an inactive status. As shown, the alarm may be set to provide either a loud or soft audible signal. Switch 32, as will be explained below, may be a button depressed to temporarily deactivate the alarm device so that the monitored apparatus, e.g., the doorknob apparatus, may be used before the alarm becomes active. Thus one can place the alarm device in an active status with switch 30, depress switch 32 to deactivate the alarm, and then exit through the monitored door using the doorknob apparatus before the alarm device becomes activated and will respond to the touching of the doorknob apparatus.

The housing 12 further mounts a light-emitting diode device 34 which is arranged, as will be described below, to periodically emit visual indications that the alarm is in an active status, and that the batteries 36 used to power the device contain sufficient charge to power the device.

Housing 12 contains an electrical circuit board carrying the circuit shown schematically in FIG. 4. The circuit is electrically connected to hanging strap 14 and is arranged to sense capacitance changes corresponding to touching of the exterior portion of the doorknob apparatus by a would-be intruder.

The intrusion alarm circuit 40 comprises RF oscillators A and B tuned to operate so that their output signals $V_A$ and $V_B$ have equal frequencies when no capacitive load is coupled to hanging strap 14. The oscillator outputs $V_A$ and $V_B$ are fed through coupling components R1, C1 and R2, C2 to a difference terminal T1. In normal operation, with no capacitive load present, the difference signal at terminal T1 is zero. The coupling of the capacitive load lowers the frequency of signal $V_A$ and causes a difference signal to appear at terminal T1 which is clamped by a clamping circuit 42 and applied to a phase detector 44. The output of phase detector 44 is applied to a negative feedback circuit 46 responsive to slowly varying signals corresponding to drift due to temperature or humidity changes and supplying negative feedback through resistor RN to oscillator B to decrease the frequency of oscillator B so it will follow oscillator A. The output of phase detector 44 also is applied to a positive feedback latching circuit 48 responsive to rapidly varying signals corresponding to the coupling of a large capacitance to hanging strap 14. The output of latching circuit 48 is applied through resistor RP to oscillator B to increase the frequency of oscillator B and thereby to maintain a difference signal at terminal T1 even when the capacitive load subsequently is removed. The output of latching circuit 48 also is applied to a detector circuit 50 which turns on an audio oscillator circuit 52 operating at about 1 K Hertz. The audio signal is modulated in a modulator 54 and applied to a speaker 56 for transduction into acoustic signals. The speaker 56 also supplies an input signal to a microphone in FM transmitter 58 to supply an FM signal to the remote receiver 20. The FM transmitter 58 is a conventional device, having its carrier frequency selected to lie in a normally unused portion of the bandwidth of receiver 20. Alternatively, the modulated electrical signal may be applied directly to the input of an FM transmitter, bypassing speaker 56 and thus allowing the speaker to be turned off if desired.

The intrusion alarm circuit 40 is placed in an active state by toggle switch 30 which has two ganged contacts to connect battery 36, typically comprising two "c" cells, into the circuit. A status monitor 60, connected to battery 36 through switch 30, includes an oscillator which develops a periodic signal $V_s$ with a low duty cycle whenever the battery voltage is above a threshhold level of, e.g., 2.4 volts. The periodic signal $V_s$ is used to connect light emitting diode 34 to battery 36 thereby generating periodic visual flashing signals, e.g., every three seconds, to show that the alarm device is working.

The intrusion alarm circuit 40 further comprises a reset circuit 62 which responds to closing of switch 32 to temporarily disable the alarm device for a predetermined period of time, such as 15 seconds, during which the doorknob apparatus may be touched without sounding an alarm.

In greater detail, oscillator A comprises a transistor Q1A, inductance L1A, capacitors C1A, C2A and C3A, and resistor R1A. The battery voltage is applied to the intermediate tap of inductor L1A, while a voltage of about 1.2 volts, developed by current flowing through resistor R3 and diodes D1 and D2 connected in parallel with capacitor C3, is applied through resistor R1A to the base of transistor Q1A. The hanging strap 14, to which the large capacitive load is coupled, is connected into the oscillator's tank circuit at the junction of inductor L1A and capacitor C1A. Coupling of a large capacitor load rapidly lowers the frequency of oscillator A from a quiescent frequency of about 2 Mhz. Oscillator B, constructed identically to oscillator A with components Q1B, L1B, etc., has the same quiescent frequency. A coupling circuit formed of resistor R4 and capacitor C4 causes oscillators A and B to be in phase in the quiescent state. When the presence of an intruder loads the tank circuit of oscillator A, the frequency of oscillator A drops, oscillators A and B are no longer in phase, and an output signal appears at terminal T1.

The AC signal at terminal T1 is clamped in clamping circuit 42, comprising diode D3 and capacitor C5, to thereby provide a bias signal. The biased input signal is applied to phase detector 44, which comprises input resistors R5 and R6, a transistor Q3 having collector resistor R7 and emitter resistor R8 and output capacitor C6. Biasing diodes D4 and D5 reduce the output voltage of transistor Q3 by two diode drops and apply it to the base of transistor Q4 across resistor R9. The collector of transistor Q4 is connected to battery 36 through a collector resistor R10, and the emitter of transistor Q4 is connected to ground through the biasing capacitor C5 in parallel with resistor R11. The output of phase detector 44 at the collector of transistor Q4 is a rectified pulsed signal whose magnitude varies with the extent the oscillators A and B are out of phase. The amplifying effect of transistors Q3 and Q4 makes phase detector 44 sensitive to small phase changes arising from temperature or humidity effects.

The output of phase detector 44 is applied both to the negative feedback stabilizing circuit 46 and to the positive feedback latching circuit 48. The stabilizing circuit 46 comprises an input filter circuit formed with resistor R12 and capacitor C7 responsive to slowly varying signals which arise from capacitance changes due to changes in temperature or humidity or the like. The voltage across capacitor C7 is applied to the input of a Darlington amplifier comprising transistors Q5 and Q6 and having an emitter follower resistor R13. The DC output voltage at the emitter of transistor Q6 is applied through a resistor RN to the base of transistor Q1B in oscillator B to provide negative feedback forcing oscillator B to follow oscillator A. Accordingly, the intrusion alarm device is able to disregard small capacitive changes not corresponding to the presence of a would-be intruder.

When an intruder appears, the large capacitance change quickly produces a large magnitude change of signal at the output of phase detector 44 which is stopped by the R12–C7 filter in stabilizing circuit 46, but which passes through coupling capacitor C8 to the input of transistor Q7 in latching circuit 48. Transistor Q7 is normally biased into a conductive state by resistor R14 and diode D6. A rapidly falling signal at the output of phase detector 44 corresponding to the presence of an intruder causes transistor Q7 to become less conductive and to cause less current to flow through collector resistor R15, thereby causing the collector voltage to rise. This rising signal is applied to the base of transistor Q1B and oscillator B through resistor RP as positive feedback causing the frequency of oscillator B to increase to cause the circuit to latch into a state of operation in which oscillators A and B remain out of phase even if the capacitive load coupled to hanging strap 14 is removed.

The output of latching circuit 48 is applied to a detector 50 comprising capacitors C9 and C10, diodes D7 and D8, and resistor R16. The output of detector 50 turns on a switch formed by transistors Q8 and Q9 arranged in Darlington configuration at the input of audio oscillator 52. The audio oscillator comprises a unijunction transistor Q10 having its base b1 connected to ground through the switch formed by transistors Q8 and Q9, and its base b2 connected to the battery voltage $V_{BB}$ through a resistor R17. The emitter of transistor Q10 is connected to ground through an adjustable timing capacitor C11 and to the battery voltage through modulator 54. Oscillation occurs when transistors Q8 and Q9 conduct, and at other times the oscillator is biassed off.

The modulator 54 comprises transistors Q11 and Q12 with their bases connected to the audio oscillator 52 through resistors R18 and R19, and being regeneratively cross coupled with capacitors C12 and C13 to drive collector resistors R20 and R21. The output of modulator 54 is taken across collector resistor R21 and applied through an input resistor R22 to an amplifying transistor Q13 connected to audio loudspeaker 56. Power for the loudspeaker is selected by switch 30 to be direct, for high volume, or through resistor R23, for low volume. Accordingly, a modulated audio signal is provided as a local alarm to signal the presence of an intruder. The modulated audio signal is also supplied to the input microphone of FM transistor 58 for transmission to a remote receiver 20.

The status monitor 60 comprises a resistor R24 supplying current to a 2.4 volt zener diode Z1 which provides a threshhold level for conduction of transistor Q14. As long as the battery voltage is above 2.4 volts, transistor Q14 will conduct through a charging circuit formed by resistor R25 and capacitor C14 to develop a periodic signal at the output of unijunction transistor Q15 having base resistors R26 and R27. The periodic signal $V_s$ appearing across base resistor R27 is applied to transistor switch Q16 to energize light emitting diode 34 through resistor R28 with battery 36, and with a charge-storing capacitor C15 paralleling the light emitting diode 34 and transistor Q16. The unijunction transistor Q15 is arranged to have a frequency to cause the light emitting diode to flash about every 3 seconds. The discharge circuit for capacitor C14 through resistor R27 has a rapid time constant, so that the light emitting diode has a very low duty cycle using negligible power.

The reset circuit 62 is arranged to cooperate with negative feedback circuit 46, and operates by changing the time constant of the input filter to a low value enabling the negative feedback circuit to follow even rapidly varying signals and to develop a negative feedback signal through resistor RN to cause oscillator B to follow any perturbation of oscillator A. The reset circuit 62 includes a charging circuit formed with resistor R30 and capacitor C16. The capacitor C16, in normal operation, carries the battery supply voltage and turns a transistor Q17 on. The collector of transistor Q17 is connected through a diode D9 to a resistor R31 across the gate-source circuit of an FET transistor Q18. The source-drain circuit of the FET transistor Q18 is connected in parallel with resistor R12. When transistor Q17 conducts, field effect transistor Q18 presents a large resistance. When switch 32 across capacitor C16 is momentarily closed, the capacitor discharges and transistor Q17 remains nonconductive until such time as the capacitor voltage again builds up through resistor R30 to a level permitting conduction. While transistor Q17 is nonconducting, the resistance of field effect transistor Q18 is small, the time constant of the input filter to circuit 46 is small, and the circuit is able to supply negative feedback even for rapid variations in capacitance at hanging strap 14.

The table below sets forth component values and types for a preferred embodiment of intrusion alarm circuit 40 as depicted in FIG. 4.

| | |
|---|---|
| R1A, R2A | 33k ohms |
| R2A, R2B | 27 |
| R1, R2 | 100k |
| R3 | 33k |
| R4 | 82k |
| R5 | 220k |
| R6 | 100k |
| R7 | 22k |
| R8 | 1k |
| R9 | 10k |
| R10 | 4.7k |
| R11 | 2.2k |
| R12 | 1M |
| R13 | 22k |
| R14 | 220k |
| R15 | 10k |
| R16 | 100k |
| R17 | 4.7k |
| R18, R19 | 62k |
| R20, R21, R22 | 1k |
| R23 | 100 |
| R24 | 22k |
| R25 | 100k |
| R26 | 2.2k |
| R27 | 200 |
| R28 | 4.7k |
| R30 | 4.7M |
| R31 | 1M |
| RN | 43k |
| RP | 220k |
| L1A, L1B | 1 mh |
| C1A, C1B | 100 pf |
| C2A, C2B | 0.1μf |
| C3A, C3B | 100 pf |
| C1, C2 | 100" |
| C3, C4 | 1000" |
| C5 | 10μf |
| C6 | .01" |

-continued

| | |
|---|---|
| C7 | 47″ |
| C8 | .01″ |
| C9 | 0.1″ |
| C10 | 1.0″ |
| C11 | 20″ |
| C12, C13 | .01″ |
| C14 | 20″ |
| C15 | 100″ |
| C16 | 10″ |
| Q1A, Q1B | NPN 5134 |
| Q3 | ″ |
| Q4 | ″ |
| Q5 | ″ |
| Q6 | ″ |
| Q7 | ″ |
| Q8 | ″ |
| Q9 | ″ |
| Q10 | UJ 2N2647 |
| Q11 | PNP 2N3639 |
| Q12 | ″ |
| Q13 | NPN 2N5134 |
| Q14 | PNP 2N3639 |
| Q15 | UJ 2N2647 |
| Q16 | NPN 2N5134 |
| Q17 | ″ |
| Q18 | N channel FET 2N3824 |
| LED 34 | 10ma Red general purpose |
| D1 | IN 914 |
| D2 | ″ |
| D3 | ″ |
| D4 | ″ |
| D5 | ″ |
| D6 | ″ |
| D7 | ″ |
| D8 | ″ |
| D9 | ″ |
| FM transmitter 58 | AMC Corp. WM-F1 |

The intrusion alarm circuit 40, while described for use with a portable intrusion alarm device 10, can be used in more permanent installations. For example, the intrusion alarm circuit 40 could be permanently mounted within a doorknob apparatus carrying switches 30, 32 and light 34, and could be powered there either with a battery or with a voltage supplied from the building's normal power supply. For another example, the alarm circuit 40 could be permanently mounted within theft-prone objects such as automobile radios or tape decks, using existing batteries and speakers.

Although a specific embodiment of the invention has been disclosed herein in detail, it is to be understood that this is for the purpose of illustrating the invention and should not be construed as necessarily limiting the invention, since it is apparent that many changes can be made to the disclosed structures by those skilled in the art to suit particular applications.

We claim:

1. A portable intrusion alarm device arranged to be hung from one part of a metallic structure, such as the interior portion of a doorknob apparatus, and to sound an alarm whenever another part of the metallic structure, such as the exterior portion of the doorknob apparatus, is touched by a would-be intruder, comprising:

a housing;

conductive means for supporting the housing from the metallic structure and for making electrical contact with the metallic structure;

said conductive means for supporting the housing comprising a strap formed of interconnected metal strands for hanging the housing from the one part of the metallic structure, a monitoring circuit within the housing and connected to the conductive means for sensing capacitance changes corresponding to touching of the metallic structure by a would-be intruder;

alarm means within the housing activated upon the sensing of a capacitance change by the monitoring circuit;

latching means within the housing for maintaining the alarm means in operation after a capacitance coupled to the metallic structure has been removed; and switch means on the exterior of the housing for causing resetting of the alarm means to a nonactivated state to permit sensing of a subsequent capacitance change.

2. A portable intrusion alarm device as claimed in claim 1 further comprising means for temporarily disabling the alarm device for a predetermined period of time during which the metallic structure may be touched without sounding an alarm, and for thereafter automatically placing the alarm device in an active status responding to touching of the doorknob apparatus.

3. A portable intrusion alarm device as claimed in claim 2 wherein the disabling means is responsive to said switch means and includes means for resetting the alarm means to a non-activated state.

4. In an intrusion alarm device associated with an apparatus to be monitored for touching by a would-be intruder and having a monitoring circuit for sensing capacitative changes and alarm means activated by the monitoring circuit; the improvement which comprises:

means for temporarily disabling the alarm device for a predetermined period of time during which the monitored apparatus may be touched without sounding an alarm, and for thereafter automatically placing the alarm device in an active status responding to touching of the monitored apparatus, whereby the alarm device may be used to monitor an apparatus, such as a doorknob, and to allow a final use of the apparatus before the alarm device becomes active.

5. An intrusion alarm device as claimed in claim 4 wherein the means for temporarily disabling the alarm device comprises a charging circuit and switch means for temporarily shorting the charging circuit.

* * * * *